US008469681B2

(12) United States Patent
Wheal

(10) Patent No.: US 8,469,681 B2
(45) Date of Patent: Jun. 25, 2013

(54) DOUBLE-DIAPHRAGM PUMPS

(75) Inventor: Peter Wheal, Worthing (GB)

(73) Assignee: Flotronic Pumps Limited, Bolney, West Sussex (GB)

( * ) Notice: Subject to any disclaimer, the term of this patent is extended or adjusted under 35 U.S.C. 154(b) by 0 days.

(21) Appl. No.: 13/266,731

(22) PCT Filed: Apr. 1, 2010

(86) PCT No.: PCT/GB2010/000651
§ 371 (c)(1),
(2), (4) Date: Oct. 27, 2011

(87) PCT Pub. No.: WO2010/125328
PCT Pub. Date: Nov. 4, 2010

(65) Prior Publication Data

US 2012/0045350 A1 Feb. 23, 2012

(30) Foreign Application Priority Data

Apr. 29, 2009 (GB) ..... 0907423.8

(51) Int. Cl.
*F04B 45/00* (2006.01)
*F04B 43/06* (2006.01)

(52) U.S. Cl.
USPC ..... 417/395; 417/538; 417/569; 417/571

(58) Field of Classification Search
USPC ..... 417/395, 538, 569, 571
See application file for complete search history.

(56) References Cited

U.S. PATENT DOCUMENTS

| | | | | | |
|---|---|---|---|---|---|
| 1,920,014 | A | | 7/1933 | Horton et al. | |
| RE29,055 | E | * | 11/1976 | Wagner | 417/388 |
| 4,008,984 | A | * | 2/1977 | Scholle | 417/393 |
| 4,172,698 | A | * | 10/1979 | Hinz et al. | 417/393 |
| 4,430,048 | A | * | 2/1984 | Fritsch | 417/383 |
| 5,062,770 | A | * | 11/1991 | Story et al. | 417/46 |
| 5,277,555 | A | * | 1/1994 | Robinson | 417/393 |

(Continued)

FOREIGN PATENT DOCUMENTS

| | | |
|---|---|---|
| EP | 0 132 913 A1 | 2/1985 |
| EP | 0 181 756 A1 | 5/1986 |

(Continued)

OTHER PUBLICATIONS

PCT/GB2010/000651 International Search Report.

(Continued)

*Primary Examiner* — Charles Freay
*Assistant Examiner* — Ryan Gatzemeyer
(74) *Attorney, Agent, or Firm* — Fay Sharpe LLP

(57) ABSTRACT

A double-diaphragm pump includes a pair of axially spaced apart pumping chambers, each chamber having a pumping diaphragm which divides each chamber into an inner and outer compartment. Inner ends of both pumping chambers are closed by a central element, and fluid is supplied to the outer compartments to cause the diaphragms to oscillate and vary the capacities of the inner compartments. I Each of the inner compartments having an inlet and an outlet port leading to unidirectional valves to allow fluid to be drawn into one of the compartments when the appropriate diaphragm moves outwardly and expelled from that compartment when the diaphragm moves inwardly. The unidirectional valves are located in inlet and outlet manifolds in the central element and are accessed and fitted through the inlet and outlet ports in the inner compartments.

9 Claims, 4 Drawing Sheets

U.S. PATENT DOCUMENTS

| | | | | |
|---|---|---|---|---|
| 5,332,372 | A * | 7/1994 | Reynolds | 417/393 |
| 6,168,394 | B1 | 1/2001 | Forman et al. | |
| 6,257,845 | B1 * | 7/2001 | Jack et al. | 417/395 |
| 6,299,415 | B1 * | 10/2001 | Bahrton | 417/395 |
| 6,468,056 | B1 * | 10/2002 | Murakoshi | 417/395 |
| 6,474,961 | B1 * | 11/2002 | Timmer et al. | 417/393 |
| 6,579,074 | B2 * | 6/2003 | Chiba | 417/307 |
| 7,134,849 | B1 | 11/2006 | Steck et al. | |
| 2005/0207912 | A1 * | 9/2005 | Lolli et al. | 417/395 |

FOREIGN PATENT DOCUMENTS

| | | | |
|---|---|---|---|
| EP | 1 113 174 | A2 | 7/2001 |
| JP | 62 131988 | | 6/1987 |
| JP | 03067076 | A | 3/1991 |

OTHER PUBLICATIONS

GB 0907423.8 Search Report under Section 17.

* cited by examiner

DOUBLE-DIAPHRAGM PUMPS

This invention relates to double-diaphragm pumps.

Double-diaphragm pumps are known and described in EP 0 181 756 B, EP 0 132 913 B and EP 1 113 174 A.

The pumps described in these documents have a central body which separates two inner chambers that form, in conjunction with a pair of flexible diaphragms, the inner portions of two pumping chambers. These central bodies contain a fluid operated valve system which controls the flow of pump fluid to and from the inner portions of the pumping chambers.

Such pumps have the advantage over many other types of pump and they can be easily installed in "line" into fluid transmission systems and the inlet and outlet manifolds are kept short.

In these pumps there is a potential product leak path to the exterior of the pump at the manifold or valve seal join, for example at a ball seat joint, because the valves are carried in a separate component which is fitted into the exterior of the central pump body, for example as shown in EP 1 113 174 A.

The present invention is intended to provide a construction in which such leakage is prevented and the new construction has valves which are only accessible once the diaphragms have been removed. Leakage is, therefore, always contained within the pump body. Should internal leakage occur, the effect is only a slight decrease in pumping efficiency and it does not present a hazard to personnel in contact with aggressive media.

According to the present invention a double-diaphragm pump comprises a pair of axially spaced apart pumping chambers, each chamber having a pumping diaphragm which divides each chamber into an inner and outer compartment, the inner ends of both pumping chambers being closed by a central element, means for supplying fluid to the outer compartments to cause the diaphragms to oscillate and vary the capacities of the inner compartments, and each of the inner compartments having an inlet and an outlet port leading to unidirectional valves to allow fluid to be drawn into one of the compartments when the appropriate diaphragm moves outwardly and expelled from that compartment when the diaphragm moves inwardly, and in which the unidirectional valves are located in inlet and outlet manifolds in the central element and are accessed and fitted through the inlet and outlet ports in the inner compartments.

With this arrangement, therefore, the unidirectional valves are located directly in the central element from inside the pumping chambers thus preventing potential leak paths through separate components carrying the valves and fitted from the exterior of the pump body.

Moreover, with this construction, the diaphragms must be removed to access the unidirectional valves.

Preferably the unidirectional valves are ball valves, the balls of which act on valve seatings which are fitted into said inlet an outlet manifolds through the inlet and outlet ports in the inner compartments.

In a convenient construction the valve seatings are screw-threaded into the central element.

The valve balls can be located in cages or housings located in said central element.

In a preferred embodiment the inlet and outlet manifolds within the central element extend away from their respective inner chambers at an acute angle relative to the plane of the rim of said respective inner chamber thus allowing a reduction in the overall width of the pump.

The central element is preferably provided in a pump body formed from a block of material in which the inner walls of the inner compartments and the inlet and outlet manifolds are formed.

The pump body can be formed from any convenient material for example metal or a synthetic plastics material, such as P.T.F.E.

The diaphragms can be held in place and the outer compartments closed by end covers.

The invention can be performed in various ways but one embodiment will now be described by way of example and with reference to the accompanying drawings in which.

Figure 2:
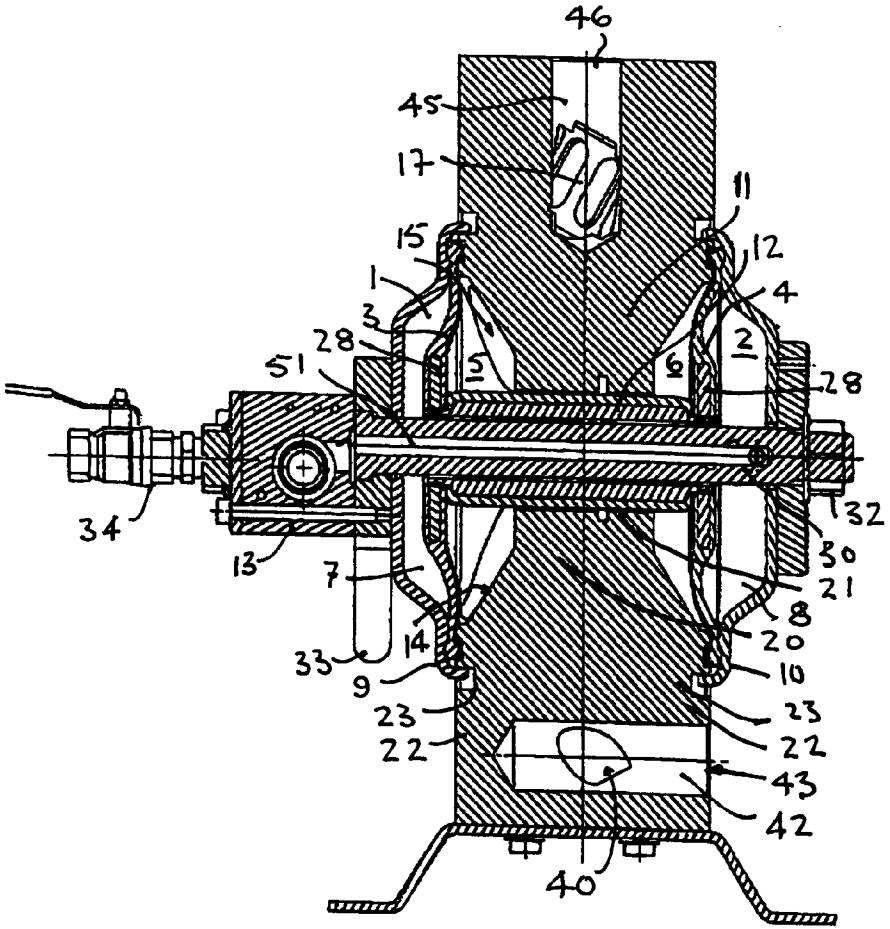
FIG. 2 is a cross-sectional view of the pump shown in FIG. 1 on the line II-II of FIG. 1.

As shown in the drawings the double-diaphragm pump according to the invention comprises a pair of axially spaced apart pumping chambers 1 and 2. Each chamber has a pumping diaphragm indicated by reference numerals 3 and 4 which divide each pumping chamber 1 and 2 into an inner compartment, indicated by reference numerals 5 and 6 and an outer compartment 7 and 8, respectively. The outer end of each pumping chamber is closed by an end cover 9 or 10 and the inner ends of both pumping chambers 1 and 2 are closed by a central element 11.

Connection means 12 extend between the diaphragms 3 and 4 and through the central element 11. Means 13 are provided for supplying operating fluid to the outer compartments 7 and 8 to cause the diaphragms 3 and 4 to oscillate and vary the capacities of the inner compartments 5 and 6, and each of these inner compartments 5 and 6 has an inlet port 14 and an outlet port 15, and which lead respectively to unidirectional inlet and outlet valves 16 and 17, as most clearly shown in FIG. 4, to allow fluid to be drawn into one of the compartments 5 or 6 and when the appropriate diaphragm 3 or 4 moves outwardly and expels from that compartment then the diaphragm 3 or 4 moves inwardly.

The central element 11 has a unitary partition wall 20 which extends between and closes the inner ends of the inner compartments 5 and 6. The wall is substantially solid over a major portion of its area apart from a sealed aperture 21 to allow the connection means 12 to pass through it.

The rims of the end covers 9 and 10 peripherally engage respectively the outer rims 23 of the outer periphery 22 of the central element 11.

The central portions of the diaphragms 3 and 4 include embedded plates 28 and are connected to opposite ends of the connections means 12 which are in the form of a hollow push rod. This push rod is slidably mounted in the sealed aperture 21 which is centrally located in the rigid central zone of the unitary partition wall 20. The end covers 9 and 10 are held together and against the rims 23 by means of an axial shaft 30 which is held at one end by clamping means 31 and nut 32 at the other.

The clamping means 31 may carry a silencer 33.

Figure 1:
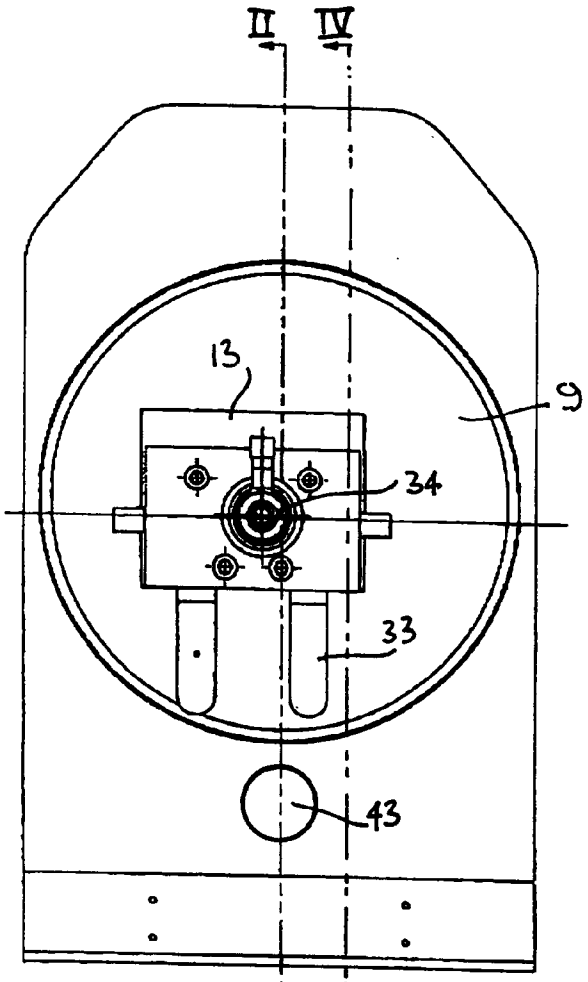
FIG. 1 is an end elevation on a double-diaphragm pump according to the present invention.
Figure 3:
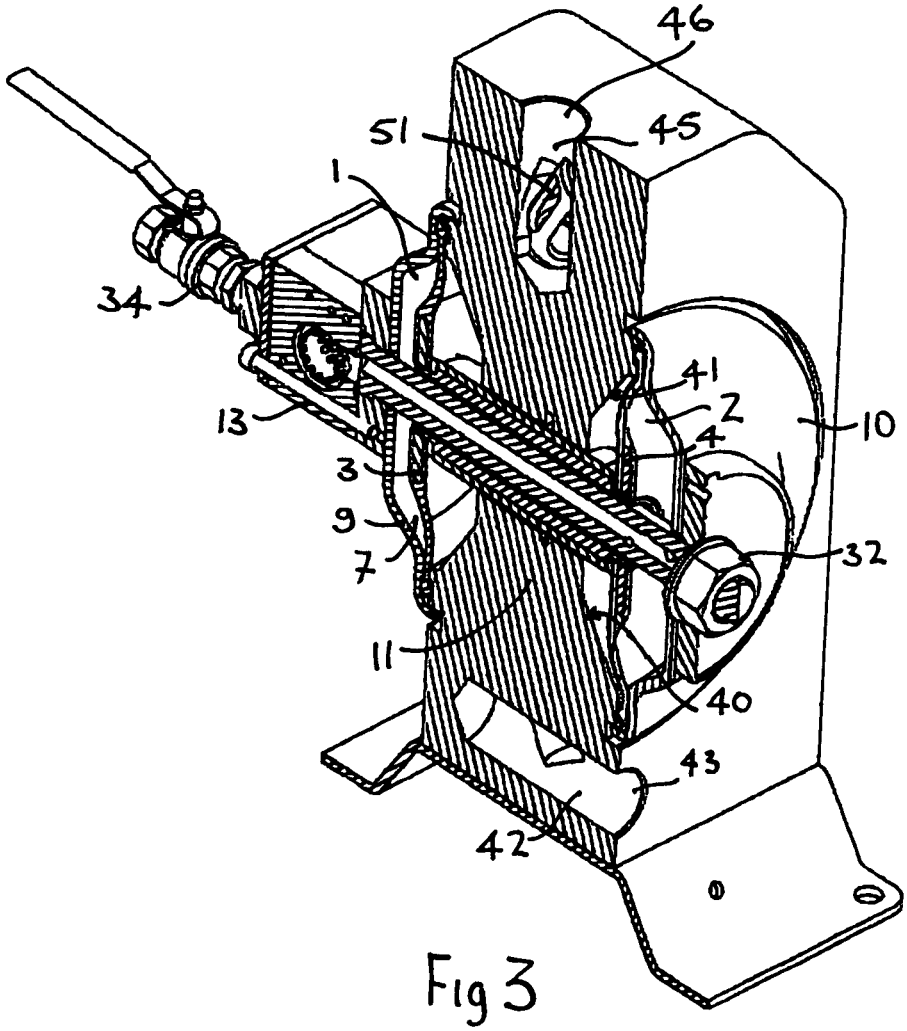
FIG. 3 is an isometric view from above of the pump shown in FIGS. 1 and 2 and in part-cross-section on the line II-II of FIG. 1.

The means 13 include a spool valve (not shown) and an air isolation valve 34. As will be seen from FIG. 1, the means 13 is slightly offset to left in relation to the centre line of the axial shaft 30.

Figure 4:
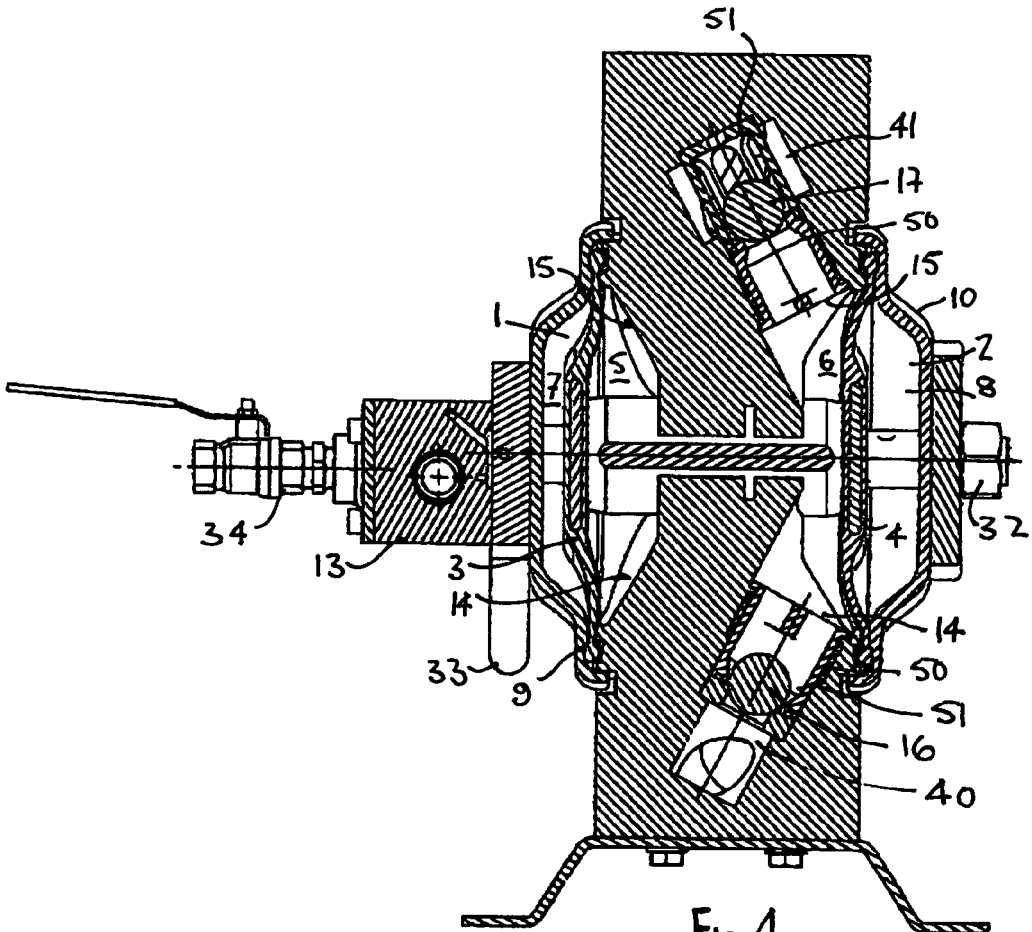
FIG. 4 is a cross-sectional view of the pump shown in FIG. 1 on the line IV-IV; and, FIG. 5 is a part-cross-sectional isometric view from above of the pump shown in FIG. 1 and in cross-section along the line IV-IV.

The unidirectional valves 16 and 17 are located respectively in an inlet manifold 40 and an outlet manifold 41. The inlet and outlet manifolds 40, 41 on the right-hand side of the pump relating to the inner compartment 6 are shown in FIG. 4 but it will be understood that identical ports, manifolds and valves are also provided for the left-hand inner compartment 5. The pairs of valves are spaced on either side of the centre line of the connection means 12 and the lower end of the manifold 40 in which the valve 16 is located joins a horizontal manifold portion 42 which has an entrance 43 in the right-hand side of the main block.

The outlet valve 17 is located in a similar manner in the manifold 41 and leads to a vertical portion 45 of the manifold which exits the block at 46. The manifolds for the left-hand inner compartment 5 also join the horizontal portion 42 or the vertical portion 45 of their respective manifolds so that they have a common entrance 43 or a common outlet 46.

The unidirectional valves 16 and 17 are ball valves, the balls of which act on valve seatings 50 which are screw threaded into the respective manifolds. The valve balls are located in cages or housings 51 to retain them in place.

Figure 5:
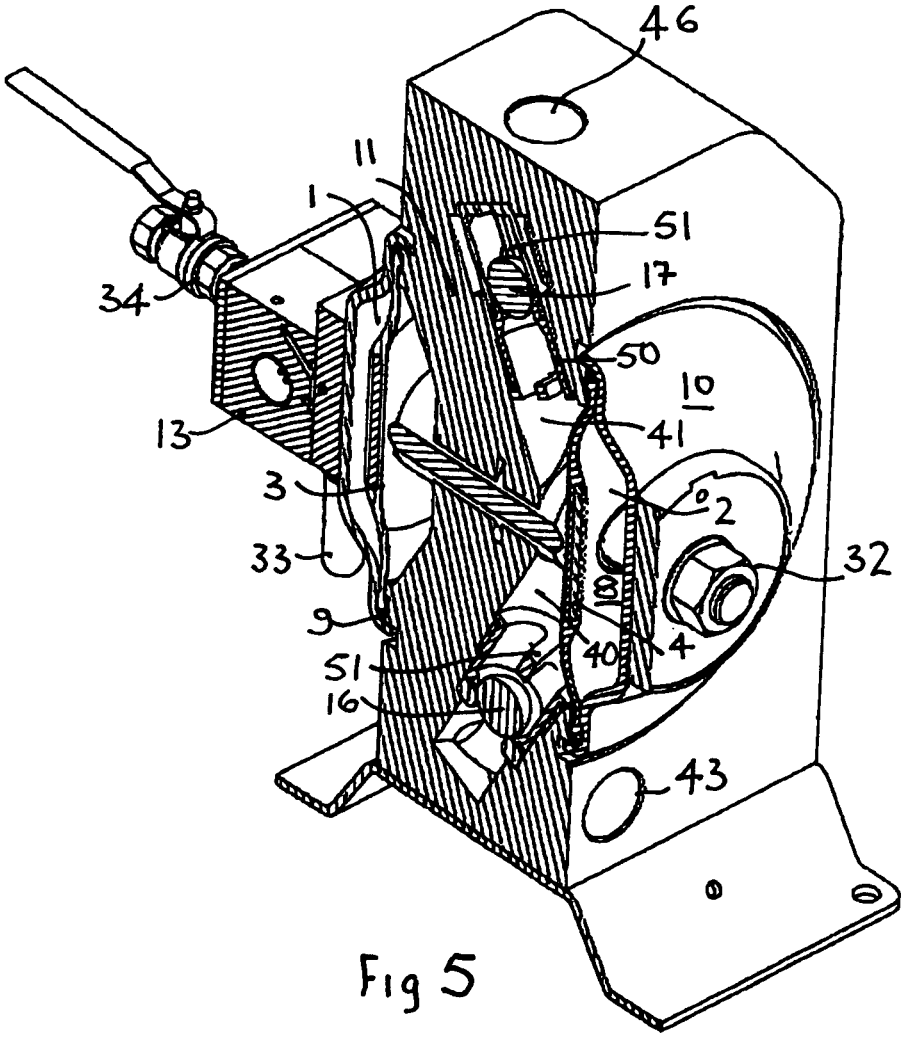

The inlet and outlet manifolds 40, 41 within the central element 11 extend away from their respective inner chambers 6 or 7 at an acute angle relative to the plane of the rim of their respective inner chamber, as will most clearly be seen from FIGS. 4 and 5 and the entrances 43 and 46 of the manifolds can carry appropriate fittings for pipe connections.

The push-rod diaphragm assembly is reciprocated by air, gas or liquid under pressure supplied to the two outer compartments 7 and 8 alternatively to form a change-over spool or other means in known manner. Such a system is described in detail in EP 0 181 756 B and the central passages for conveying the operating fluid are indicated by reference numeral 51. The reciprocating movement of the push-rod diaphragm assembly alternately increases and decreases the volume of the inner compartments 5 and 6. This leads to fluid being drawn into the compartment whose volume is being increased through one of the lower inlet ports 14 from the manifold 40. Similarly fluid is expelled from the compartment whose volume is being reduced through one of the upper outlet ports 15 into the outlet manifold 41. Such operation is conventional for double-diaphragm pumps.

The central element 11 is formed in a main pump body formed from a single block of material in which the inner walls of the inner compartments 6 and 7, and the inlet and outlet manifolds are formed. Thus, the pump body can be formed from a synthetic plastics material (for example P.T.F.E.).

The use of angled manifolds enables the overall dimensions of the main body to be kept as small as possible.

Due to the construction and layout of the manifolds their location within the main body there are no external fittings, thus the valve seats 50 can only be inserted into the manifolds by passing them through the appropriate inlet or outlet port 14 or 15 and this will require the removal of the appropriate diaphragm. The result is that any leakage path through the valve is always contained within the pump body. Should internal leakage occur, the effect would only be a slight decrease in pumping efficiency and not present a hazard to personnel through contact with aggressive media.

The use of P.T.F.E. for the main body will enable the pump to handle the greatest range of, potentially, hazardous chemicals although other materials may be considered, if desired.

The invention claimed is:

1. A double-diaphragm pump comprising a pair of axially spaced apart pumping chambers, each chamber having a pumping diaphragm which divides each chamber into an inner and an outer compartment, the inner ends of both pumping chambers being formed by a central element, a mechanism supplying fluid to the outer compartments to cause the diaphragms to oscillate and vary the capacities of the inner compartments and each of the inner compartments having an inlet port leading to an inlet manifold in the central element and an outlet port leading to an outlet manifold in the central element, and wherein unidirectional valves are located inside of the inlet and outlet manifolds to allow fluid to be drawn into one of the compartments through the inlet port of that compartment from the inlet manifold of that compartment when the appropriate diaphragm moves outwardly and to allow the fluid to be expelled from that compartment through the outlet port of the compartment into the outlet manifold of that compartment when the diaphragm moves inwardly, and in which the unidirectional valves are accessed and fitted through the inlet and outlet ports in the inner compartments when the diaphragms are absent, and wherein the inlet and outlet manifolds within the central element extend away from their respective chambers at an acute angle relative to the plane of the rim of said respective inner chamber.

2. A double-diaphragm pump as claimed in claim 1 in which the unidirectional valves are ball valves the balls of which act as valve seatings which are fitted into said inlet and outlet manifolds through the inlet and outlet ports.

3. A double-diaphragm pump as claimed in claim 2 in which the valve seatings are screw threaded into said manifolds.

4. A double-diaphragm pump as claimed in claim 2 in which the valve balls are located in cages located inside said inlet and outlet manifolds.

5. A double-diaphragm pump as claimed in claim 1 in which said central element is provided in a pump body formed from a block of material in which the inner walls of the inner compartments and the inlet and outlet manifolds are formed.

6. A double-diaphragm pump as claimed in claim 5 in which the pump body is formed from a synthetic plastics material.

7. A double-diaphragm pump as claimed in claim 6 in which the pump body is formed from P.T.F.E.

8. A double-diaphragm pump as claimed in claim 1 in which the diaphragms must be removed to access the unidirectional valves.

9. A double-diaphragm pump as claimed in claim 1 in which the diaphragms are held in place and the outer compartments are closed by end covers.

* * * * *